US008106835B2

(12) United States Patent
Chien et al.

(10) Patent No.: US 8,106,835 B2
(45) Date of Patent: Jan. 31, 2012

(54) DUAL-BAND ANTENNA

(75) Inventors: Ming-Cheng Chien, Taoyuan County (TW); Shih-Chieh Cheng, Tainan County (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 379 days.

(21) Appl. No.: 12/540,774

(22) Filed: Aug. 13, 2009

(65) Prior Publication Data

US 2010/0039330 A1 Feb. 18, 2010

(30) Foreign Application Priority Data

Aug. 15, 2008 (TW) ..... 97131113 A

(51) Int. Cl.
*H01Q 1/38* (2006.01)

(52) U.S. Cl. ..... 343/700 MS

(58) Field of Classification Search ..... 343/700, 343/702

See application file for complete search history.

(56) References Cited

U.S. PATENT DOCUMENTS

| | | | | |
|---|---|---|---|---|
| 5,786,793 | A * | 7/1998 | Maeda et al. | 343/700 MS |
| 6,801,169 | B1 * | 10/2004 | Chang et al. | 343/700 MS |
| 7,106,257 | B2 * | 9/2006 | Liu et al. | 343/700 MS |
| 2004/0125033 | A1 * | 7/2004 | Yuanzhu | 343/702 |

* cited by examiner

*Primary Examiner* — Tho G Phan

(74) *Attorney, Agent, or Firm* — Muncy, Geissler, Olds & Lowe, PLLC

(57) ABSTRACT

A dual-band antenna is disposed on a substrate having an antenna-mounted surface. The dual-band antenna includes a first radiating unit, a second radiating unit, and a feeding terminal. The first radiating unit is disposed opposite to the antenna-mounted surface of the substrate, and at least has a first side, a second side and, a third side. The first side is opposite to the third side, and the length of the first side is not equal to that of the third side. The second side is connected to the first side and the third side. The second radiating unit is connected to the first side of the first radiating unit. The feeding terminal is connected to the third side of the first radiating unit and the antenna-mounted surface of the substrate.

20 Claims, 4 Drawing Sheets

DUAL-BAND ANTENNA

CROSS REFERENCE TO RELATED APPLICATIONS

This Non-provisional application claims priority under 35 U.S.C. §119(a) on Patent Application No(s). 097131113 filed in Taiwan, Republic of China on Aug. 15, 2008, the entire contents of which are hereby incorporated by reference.

BACKGROUND OF THE INVENTION

1. Field of Invention

The present invention relates to an antenna and, in particular, to a dual-band antenna.

2. Related Art

The vigorous development of the wireless transmission brings various kinds of applications for multi-band transmission products and technology, so that many new products have the function of wireless transmission to satisfy the consumers' needs. An antenna is the very important element for transmitting and receiving the electromagnetic wave energy in the wireless transmission system. Without it, the wireless transmission system will not be able to transmit and receive data. A proper antenna may not only match the appearance of the product and enhance the properties of transmission, and also further reduce the product cost.

The common band protocols are such as the Wi-Fi (IEEE 802.11) and Bluetooth (IEEE 802.15.1) communication. Bluetooth devices operate within 2.4 GHz band. The 802.11 also includes 802.11a 802.11b, 802.11g, and 802.11n that are specifically defined for the 5 GHz band and 2.4 GHz band.

However, each country has a different open band especially for IEEE 802.11a. The components for IEEE 802.11a must adapt to different band ranges, for example, a high band (5.47 to 5.725 GHz) is needed to support an output of 1 W in European countries for fitting in every channel. Also, the band range of the common dual-band antenna can only cover a part of the range; hence the operating range of the product is limited under the band regulations in different countries. Thus, the application products of the dipole antenna cannot be used in every country.

Additionally, the frequency band allocation of WiMax (IEEE 802.16) that each country has been gradually opened on still does not have a global standard. In each country, only the licensed frequency band can be used for WiMax. For example, a frequency band from 2.3 GHz to 2.4 GHz is used for WiMax in Korea, and three WiMax licenses have been issued there. A frequency band from 2.5 GHz to 2.7 GHz that is used for WiMax in the U.S., Canada, Singapore, and Israel is categorized as the U.S. regulation. A frequency band from 3.4 GHz to 3.6 GHz that is used for WiMax in China and European countries is categorized as the European regulation. Therefore, the application products of the dipole antenna need to fit into the different regulations in different countries.

According to the above, one of the important subjects is to increase the operating band range of the dual-band antenna so that the application products of the dual-band antenna can fit into the regulations of more countries.

SUMMARY OF THE INVENTION

In view of the foregoing, the present invention is to provide a dual-band antenna that can increase the operating bandwidth.

To achieve the above, a dual-band antenna of the present invention is disposed on a substrate, which has an antenna-mounted surface. The dual-band antenna includes a first radiating unit, a second radiating unit, and a feeding terminal. The first radiating unit is disposed opposite to the antenna-mounted surface of the substrate, and at least has a first side, a second side, and a third side. The first side is disposed opposite to the third side and the length of the first side is not equal to that of the third side. The second side is connected to the first side and the third side. The second radiating unit is connected to the first side of the first radiating unit. The feeding terminal is connected to the third side of the first radiating unit and the antenna-mounted surface of the substrate.

As mentioned above, the dual-band antenna of the present invention uses the first radiating unit and the second radiating unit to achieve the dual-band effect. The length of the first side of the first radiating unit is greater than that of the third side; alternatively, the length of the first side of the first radiating unit is smaller than that of the third side. After the signal is fed to the feeding terminal, the signal may be transmitted to the second radiating unit by traveling wave so as to increase the operating band range of the dual-band antenna. The connecting location of the feeding terminal and the third side of the first radiating unit is close to the connecting location of the second side and the third side. The antenna-mounted surface of the substrate disposed opposite to the first radiating unit does not have any electronic element.

As described above, the second radiating unit of the dual-band antenna according to the present invention further includes a connecting part and a radiating part. One end of the connecting part is connected to the first side of the first radiating unit. Another end of the connecting part is connected to the radiating part, so that the radiating part is disposed substantially perpendicular or parallel to the first radiating unit. The dual-band antenna of the present invention uses the second radiating unit and the feeding terminal as supporting points, and is bonded to the substrate suitably by the surface mount technology (SMT), which is an automatic production process.

To achieve the above, a dual-band antenna of the present invention is disposed on a substrate, which has an antenna-mounted surface. The dual-band antenna includes a first radiating unit, a second radiating unit, and a feeding terminal. The first radiating unit is disposed opposite to the antenna-mounted surface of the substrate, and at least has a first side, a second side, and a third side. One of an acute angle or an obtuse angle is formed between the first side and the second side, and the first side is disposed opposite to the third side. The second radiating unit is connected to the first side of the first radiating unit. The feeding terminal is connected to the third side of the first radiating unit and the antenna-mounted surface of the substrate. A partial signal inputted from the feeding terminal is transmitted to the second radiating unit through the second side.

As mentioned above, the dual-band antenna of the present invention uses the first radiating unit and the second radiating unit to achieve the dual-band effect. In addition, an acute angle or an obtuse angle is formed between the first side and the second side. With the acute angle or the obtuse angle, after the signal is fed from the feeding terminal, the signal may be transmitted to the second radiating unit along the second side by traveling wave so as to increase the operating band range of the dual-band antenna. The connecting location of the feeding terminal and the third side of the first radiating unit is close to the connecting location of the second side and the third side. The antenna-mounted surface of the substrate disposed opposite to the first radiating unit does not have any electronic element.

As described above, the second radiating unit of the dual-band antenna according to the present invention further includes a connecting part and a radiating part. One end of the connecting part is connected to the first side of the first radiating unit. Another end of the connecting part is connected to the radiating part so that the radiating part is disposed substantially perpendicular or parallel to the first radiating unit. The dual-band of the present invention uses the second radiating unit and the feeding terminal as the supporting points, and is bonded to the substrate suitably by SMT, which is an automatic production process.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
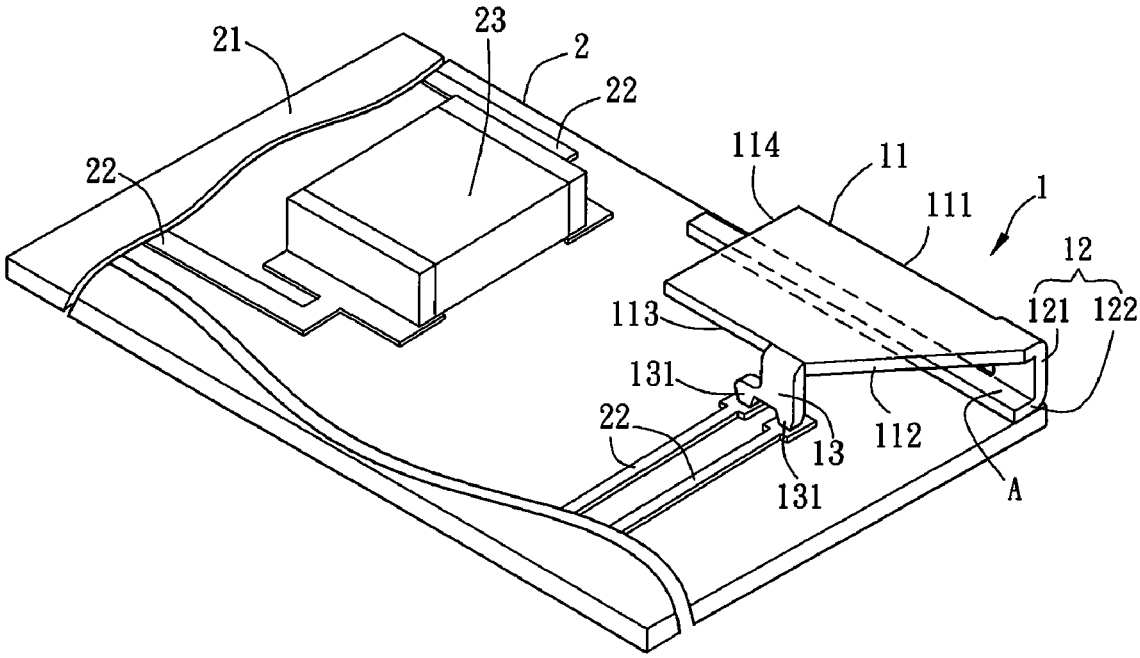
FIG. 1A is a schematic view of a dual-band antenna according to a preferred embodiment of the present invention.

FIG. 1A is a schematic view of a dual-band antenna 1 according to a preferred embodiment of the present invention. As shown in FIG. 1A, a dual-band antenna 1 according to the preferred embodiment of the present invention is disposed on a substrate 2, which has an antenna-mounted surface 21, a conductor layer 22, and at least one electronic element 23. In the embodiment, the dual-band antenna 1 is a surface-mounted antenna for example. The dual-band antenna 1 is mounted on the antenna-mounted surface 21 by surface mount technology (SMT) and electrically connected to the electronic element 23 through the conductor layer 22. The electronic element 23 may be an active element or a passive element. The material of the conductor layer 22 may be copper foil.

The substrate 2 may be a printed circuit board (PCB) made of bismaleimide triazine (BT) resin or fiberglass reinforced epoxy resin (FR4). Alternatively, the substrate 2 may also be a flexible film substrate made of polyimide.

As shown in FIG. 1A, the dual-band antenna 1 includes a first radiating unit 11, a second radiating unit 12 and a feeding terminal 13. In the embodiment, the first radiating unit 11, the second radiating unit 12 and the feeding terminal 13 are integrally formed. Additionally, the first radiating unit 11, the second radiating unit 12, and the feeding terminal 13 of the dual-band antenna 1 may be produced from a conductive thin sheet or a metal thin sheet.

Figure 1B:
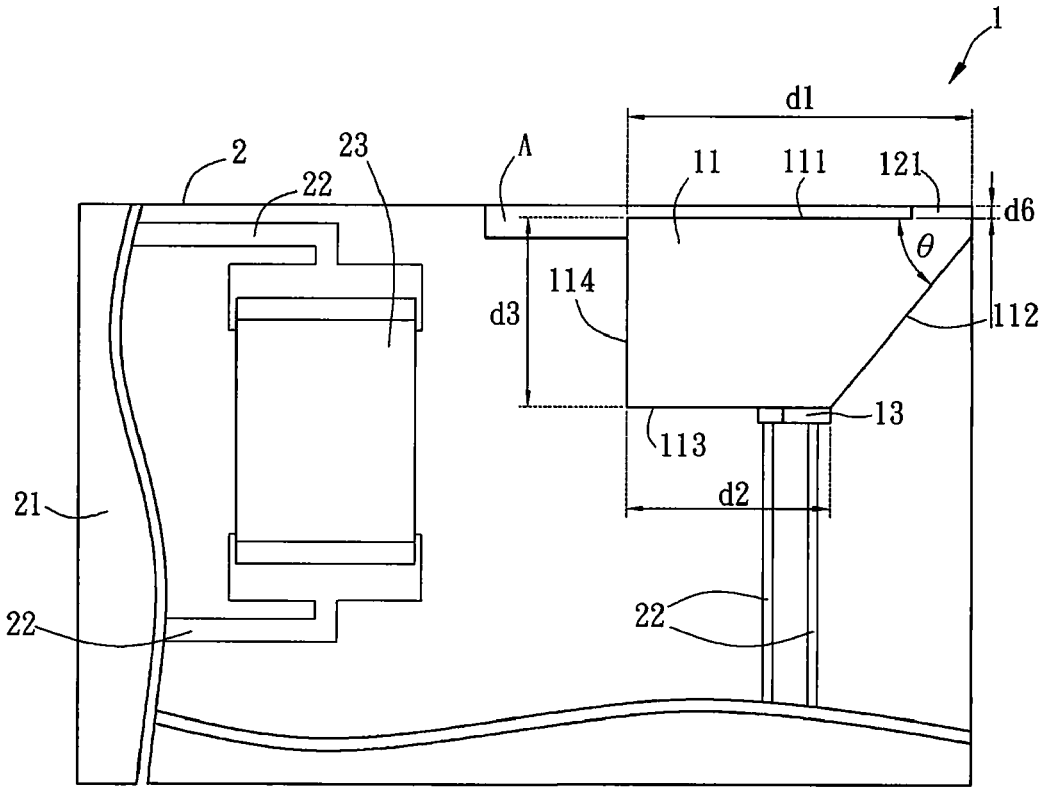
FIG. 1B is atop view of FIG. 1A.
Figure 1C:
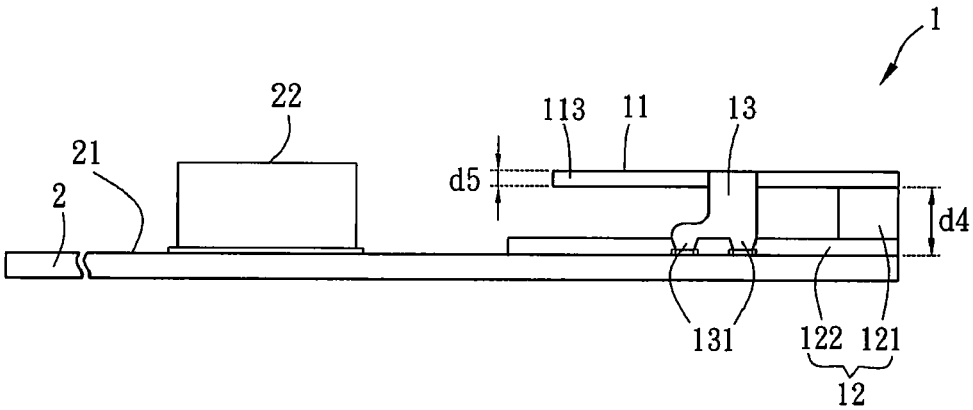
FIG. 1C is a side view of FIG. 1A.

FIG. 1B is a top view of the dual-band antenna 1, and FIG. 1C is a side view of the dual-band antenna 1. Referring to FIGS. 1A, 1B, and 1C, the first radiating unit 11 is disposed opposite to the antenna-mounted surface 21 of the substrate 2. The first radiating unit 11 at least has a first side 111, a second side 112, and a third side 113. The first side 111 is disposed opposite to the third side 113, and the second side 112 is connected to the first side 111 and the third side 113. The length d1 of the first side 111 is not equal to the length d2 of the third side 113, for example, the length d1 is larger than length d2 (as shown in FIG. 1B).

In the embodiment, the distance between the first radiating unit 11 and the substrate 2 is about 2.9 mm to 5 mm for example. The thickness d5 of the first radiating unit 11 is about 0.3 mm to 0.6 mm for example (as shown in FIG. 1C). Moreover, the first radiating unit 11 further includes a fourth side 114 that is connected to the first side 111 and the third side 113, and forms a right angle with the first side 111 and the third side 113, respectively. The ratio of the length d1 of the first side 111 to the length d3 of the fourth side 114 is, for example, about 1.5 (as shown in FIG. 1B). Since the length d1 of the first side 111 is larger than the length d2 of the third side 113, the second side 112 is relatively slanting compared to the fourth side 114. An acute angle θ that is formed between the first side 111 and the second side 112 (as shown in FIG. 1B) is between 30 and 60 degrees. It is noted that the first radiating unit 11 may be a polygon, for example, a quadrangle in the embodiment. Furthermore, the space formed between the antenna-mounted surface 21 and the first radiating unit 11 does not have the conductor layer 22 or the electronic element 23 for preventing the standing wave generated from the capacitive effect that can further affect the property of the dual-band antenna 1.

With reference to FIGS. 1A and 1B, the second radiating unit 12 is connected to the first radiating unit 11. In the embodiment, the second radiating unit 12 includes a connecting part 121 and a radiating part 122. One end of the connecting part 121 is connected to the first side of the first radiating unit 11. Another end of the connecting part 121 is connected to the radiating part 122. The radiating part 122 is disposed on the antenna-mounted surface 21, for example, the radiating part 122 contacts the antenna-mounted surface 21. In addition, a space (not shown) may be kept between the radiating part 122 and the antenna-mounted surface 21. Moreover, the radiating part 122 has a resonant surface A that is substantially parallel to the antenna-mounted surface 21. The thickness d6 of the second radiating unit 12 (as shown in FIG. 1B) is about 0.3 mm to 0.6 mm, for example. Since the tolerance still exists in the antenna manufacturing, the size of the above dual-band antenna 1 is used as an example rather than a scope limitation.

Please refer to FIG. 1A, the feeding terminal 13 is connected to the first radiating unit 11 and the antenna-mounted surface 21 of the substrate 2. In the embodiment, one end of the feeding terminal 13 is connected to the third side 113. Another end of the feeding terminal 13 has at least one electrical connecting part 131, which is electrically connected to the substrate 2. For that, another end of the feeding terminal 13 that has two of the electrical connecting parts 131 surface-mounted on the antenna-mounted surface 21 is used as an example. The second radiating unit 12 and the electrical connecting parts 131 are used as supporting points that can be fixed on the substrate 2 by SMT, which is an automatic production process, so as to increase the reliability of the dual-band antenna 1. The number of the electrical connecting part 131 may, but not limited to, be increased depending on the actual requirement.

As the signal is transmitted to the second radiating unit 12 along the second side 112, since the acute angle θ is formed between the first side 111 and the second side 112, the signal may be transmitted to the second radiating unit 12 by traveling wave after the signal is fed to the feeding terminal 13, so as to increase the operating band range of the dual-band antenna 1. Furthermore, since the dual-band antenna 1 does not have the ground, it can be used for the open-circuit testing or the closed-circuit testing to ensure the quality of the dual-antenna 1.

Figure 2:
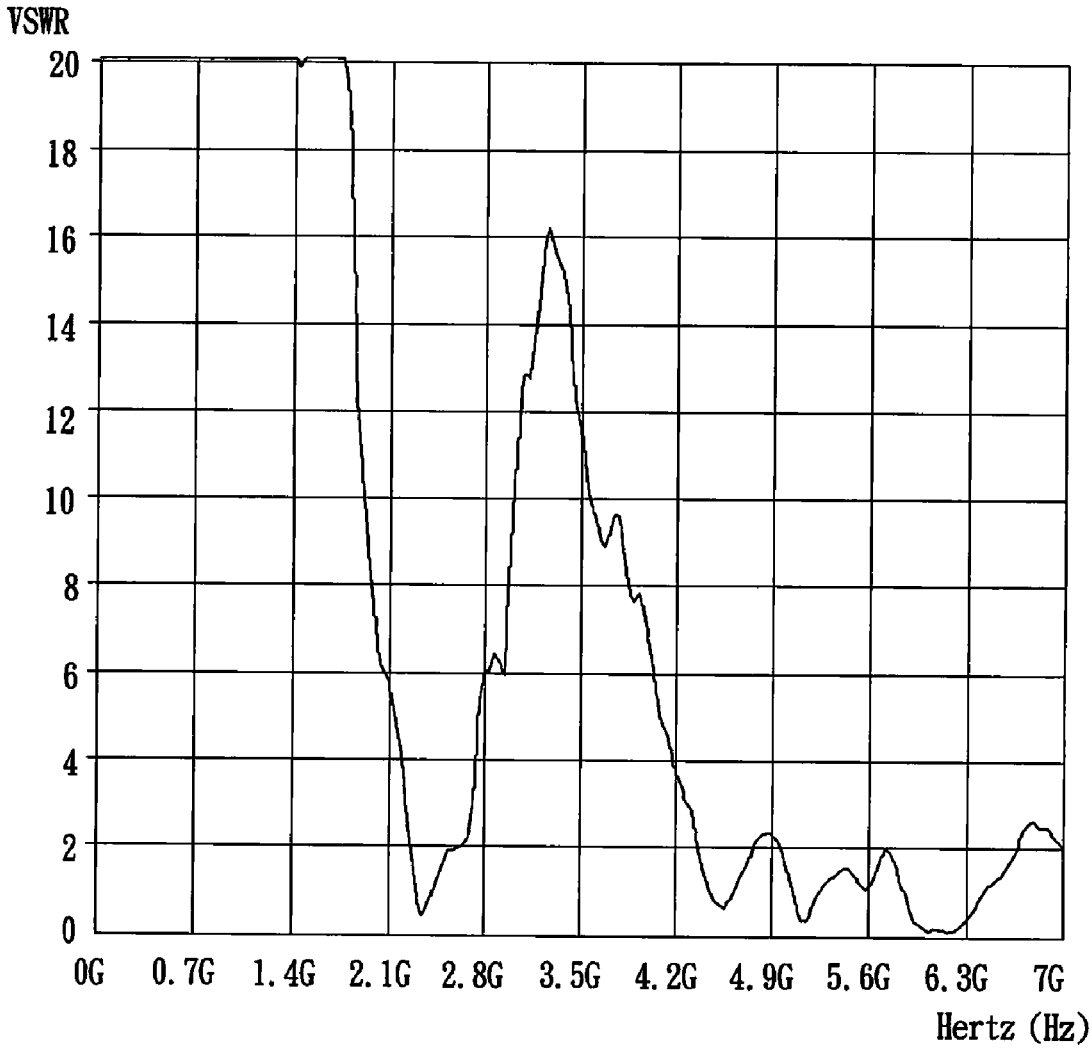
FIG. 2 is a diagram showing the measurement of a band range used by the dual-band antenna according to the preferred embodiment of the present invention.

Additionally, FIG. 2 is a diagram shows the measurement of a band range used by the dual-band antenna 1 according to the preferred embodiment of the present invention. With reference to FIG. 2, the vertical axis represents the voltage standing wave ratio (VSWR) and the horizontal axis represents the frequency. In accordance with the definition that the VSWR is less than 2, the first radiating unit 11 is operated between 5 GHz and 6.7 GHz in the embodiment, and the second radiating unit 12 is operated between 2.3 GHz and 2.7 GHz. However, depending on the actual requirement, if the influence of the bandwidth with the frequency between 4.7 GHz and 5 GHz (VSWR larger than 2) is not considered, the first radiating unit 11 may be operated between 4.4 GHz and 6.7 GHz, so that the dual-band antenna 1 can be operated in a larger band range.

Figure 3:
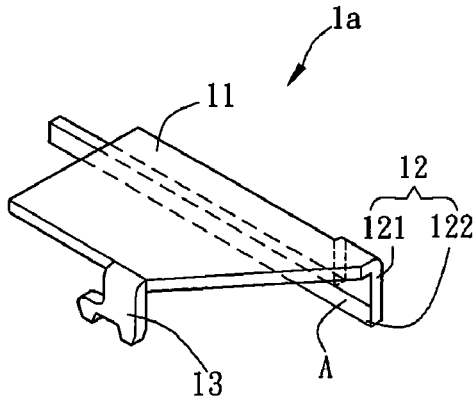
FIGS. 3 to 5 are schematic views of other aspects of the dual-band antenna according to the preferred embodiment of the present invention.
Figure 4:
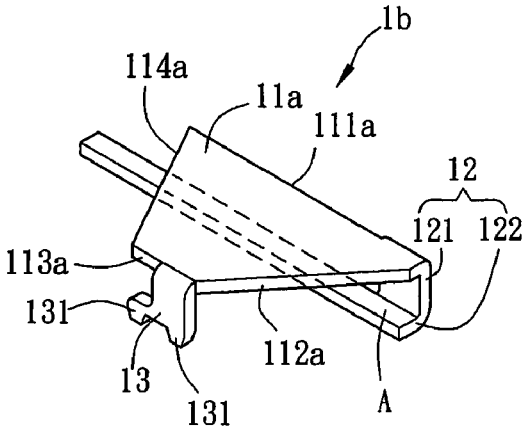
Figure 5:
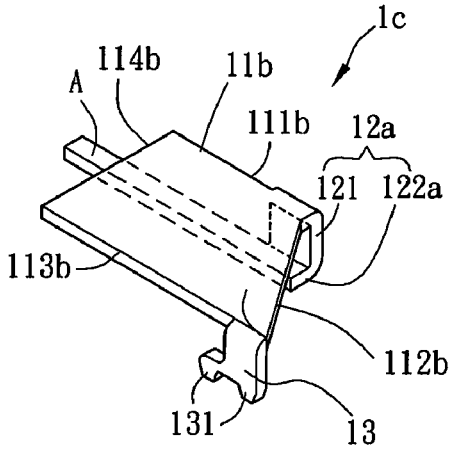

FIGS. 3, 4, and 5 show the other aspects of the dual-band antenna 1 according to the preferred embodiment of the present invention. As shown in FIG. 3, the difference between the dual-band antenna 1 and a dual-band antenna 1*a* is that the resonant surface A of the radiating part 122 of the dual-band antenna 1*a* is perpendicular to the antenna-mounted surface 21. As shown in FIG. 4, the difference between the dual-band antenna 1 and a dual-band antenna 1*b* is that the first radiating unit 11*a* of the dual-band antenna 1*b* is a trapezoid for example, which means, an acute angle is formed between a first side 111*a* and a second side 112*a*, and another acute angle is formed between the first side 111*a* and a fourth side 114*a*. As shown in FIG. 5, the difference between the dual-band antenna 1 and a dual-band antenna 1*c* is that the length of a first side 111*b* of the first radiating unit 11*b* of the dual-band antenna 1*c* is less than the length of a third side 113*b*. An obtuse angle that is formed between the first side 111*b* and a second side 112*b* is between 120 and 150 degrees. One end of the connecting part 121 is connected to the first side 111*b*. Another end of the connecting part is connected to a radiating part 122*a*, which contacts the antenna-mounted surface 21. The above aspects are used as examples rather than to limit the shape and appearance of the dual-band antenna of the present invention.

To sum up, the dual-band antenna of the present invention uses the first radiating unit and the second radiating unit to achieve the dual-band effect. In addition, since the length of the first side of the radiating unit is not equal to the length of the third side, an acute or an obtuse angle is formed between the first side and the second side. With the acute or the obtuse angle, after the signal is fed to the feeding terminal, the signal may be transmitted to the second radiating unit along the second side by traveling wave, so as to increase the operating band range of the dual-band antenna 1.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dual-band antenna disposed on a substrate, the substrate having an antenna-mounted surface, the dual-band antenna comprising:

a first radiating unit disposed opposite to the antenna-mounted surface of the substrate, and at least having a first side, a second side, and a third side, wherein the first side is disposed opposite to the third side, the length of the first side is not equal to that of the third side, and the second side is connected to the first side and the third side;

a second radiating unit connected to the first side of the first radiating unit; and a feeding terminal connected to the third side of the first radiating unit and the antenna-mounted surface of the substrate.

2. The dual-band antenna according to claim 1, wherein the thickness of the first radiating unit or the second radiating unit is about 0.3 mm to 0.6 mm.

3. The dual-band antenna according to claim 1, wherein the distance between the first radiating unit and the substrate is about 2.9 mm to 5 mm.

4. The dual-band antenna according to claim 1, wherein an acute angle or an obtuse angle is formed between the first side and the second side.

5. The dual-band antenna according to claim 1, wherein the feeding terminal comprises an electrical connecting part electrically connected to the substrate.

6. The dual-band antenna according to claim 1, wherein the second radiating unit comprises a connecting part and a radiating part, and the connecting part is connected to the radiating part and the first side of the first radiating unit.

7. The dual-band antenna according to claim 6, wherein the radiating part comprises a resonant surface disposed substantially perpendicular or parallel to the antenna-mounted surface.

8. The dual-band antenna according to claim 1, wherein the first radiating unit further comprises a fourth side connected to the first side and the third side, and the ratio of a length of the first side to a length of the fourth side is 1.5.

9. The dual-band antenna according to claim 1, wherein the first radiating unit, the second radiating unit, and the feeding terminal are integrally formed.

10. The dual-band antenna according to claim 1 disposed to the substrate by surface mount technology (SMT).

11. The dual-band antenna according to claim 1, wherein the antenna-mounted surface of the substrate disposed opposite to the first radiating unit does not have any electronic element.

12. The dual-antenna according to claim 1, wherein a connecting location of the feeding terminal and the third side of the first radiating unit is close to the connecting location of the second side and the third side of the first radiating unit.

13. A dual-band antenna disposed on a substrate, the substrate having an antenna-mounted surface, the dual-band antenna comprising:

a first radiating unit disposed opposite to the antenna-mounted surface of the substrate and at least having a first side, a second side, and a third side, wherein one of an acute angle and an obtuse angle is formed between the first side and the second side, and the first side is disposed opposite to the third side;

a second radiating unit connected to the first side of the first radiating unit; and a feeding terminal connected to the third side of the first radiating unit and the antenna-mounted surface of the substrate;

wherein a partial signal inputted from the feeding terminal is transmitted from the second side to the second radiating unit.

14. The dual-band antenna according to claim 13, wherein the acute angle is between 30 and 60 degrees.

15. The dual-band antenna according to claim 13, wherein the obtuse angle is between 120 and 150 degrees.

16. The dual-band antenna according to claim 13, wherein the second radiating unit comprises a connecting part and a radiating part, and the connecting part is connected to a first radiating unit and the radiating unit.

17. The dual-band antenna according to claim 16, wherein the radiating part comprises a resonant surface disposed substantially perpendicular or parallel to the antenna-mounted surface.

18. The dual-band antenna according to claim 13, wherein the first radiating unit, the second radiating unit, and the feeding terminal are integrally formed.

19. The dual-band antenna according to claim 13, wherein the second radiating unit and the feeding terminal are connected to the substrate by SMT.

20. The dual-band antenna according to claim 13, wherein the connecting location of the feeding terminal and the third side of the first radiating unit is close to the connecting location of the second side and the third side of the first radiating unit.

* * * * *